US008047581B2

(12) United States Patent
Corre et al.

(10) Patent No.: US 8,047,581 B2
(45) Date of Patent: Nov. 1, 2011

(54) TEMPORARY CLOSURE DEVICE FOR AN OPENING ELEMENT ON A FIXED CHASSIS PART OF A MOTOR VEHICLE, COMPRISING AN IMPROVED RETURN MEANS

(75) Inventors: Didier Corre, Le Chesnay (FR); Fabrice Hermetz, Paris (FR); Alexandre Astorg, Le Coudray Montceaux (FR); Virginie Huguon, Bagneux (FR)

(73) Assignee: Exsto, Romans sur Isere (FR)

( * ) Notice: Subject to any disclaimer, the term of this patent is extended or adjusted under 35 U.S.C. 154(b) by 742 days.

(21) Appl. No.: 11/920,119

(22) PCT Filed: May 4, 2006

(86) PCT No.: PCT/FR2006/050414

§ 371 (c)(1),
(2), (4) Date: Nov. 9, 2007

(87) PCT Pub. No.: WO2007/000524

PCT Pub. Date: Jan. 4, 2007

(65) Prior Publication Data

US 2009/0021025 A1 Jan. 22, 2009

(30) Foreign Application Priority Data

May 12, 2005 (FR) ..... 05 51224
May 12, 2005 (FR) ..... 05 51225
May 12, 2005 (FR) ..... 05 51226
May 12, 2005 (FR) ..... 05 51227
May 12, 2005 (FR) ..... 05 51228

(51) Int. Cl.
*E05C 19/06* (2006.01)
*E05C 17/04* (2006.01)

(52) U.S. Cl. ..... 292/87; 292/262; 292/DIG. 38; 24/295

(58) Field of Classification Search ..... 292/259 A, 292/262, 338, 1, 76, 80, 87, 303, DIG. 38, 292/DIG. 53, DIG. 54, 81, DIG. 63; 296/35.1; 118/500; 24/289, 293–295, 297, 457, 458; 16/82; 49/503; 248/221.11, 222.11
See application file for complete search history.

(56) References Cited

U.S. PATENT DOCUMENTS 436,035 A * 9/1890 Grothaus ..... 292/303
(Continued)

FOREIGN PATENT DOCUMENTS

DE 20 2004 012 900 U1 11/2004
(Continued)

OTHER PUBLICATIONS

Computer generated translation for FR 2833562 A1, http://gb.espacenet.com.*

*Primary Examiner* — Carlos Lugo
*Assistant Examiner* — Alyson M Merlino
(74) *Attorney, Agent, or Firm* — Oliff & Berridge, PLC

(57) ABSTRACT

A temporary closure device for an opening element on a fixed chassis part of a motor vehicle, in which the opening element includes a housing for receiving a lock and the fixed part includes at least one tapped hole for fixing a strike. The device includes a plastic body equipped with means for mounting it in the tapped hole. An end of the device includes a limit stop element that co-operates with a first rim of the housing as the opening element is closed, while another end of the device includes a means for retaining the opening element in the closed position against the fixed part, which is intended to penetrate the housing behind a second rim thereof. The retaining means is formed by a resilient tongue, which can bend under stress from the second rim when the opening element is moved from the free position to the closed position.

19 Claims, 5 Drawing Sheets

U.S. PATENT DOCUMENTS

| | | | | | |
|---|---|---|---|---|---|
| 1,837,517 | A | * | 12/1931 | Ball | 16/82 |
| 2,199,369 | A | * | 4/1940 | Bernstein | 292/288 |
| 3,313,564 | A | * | 4/1967 | Pultz | 292/87 |
| 3,756,550 | A | * | 9/1973 | Kollitz | 248/206.5 |
| 3,807,964 | A | * | 4/1974 | Meyer | 24/295 |
| 4,593,946 | A | * | 6/1986 | Rich | 292/288 |
| 4,683,622 | A | * | 8/1987 | Oehlke | 24/458 |
| 5,013,073 | A | * | 5/1991 | Pehr | 292/87 |
| 5,158,329 | A | * | 10/1992 | Schlack | 292/87 |
| 5,344,198 | A | * | 9/1994 | Elliott | 292/340 |
| 5,347,690 | A | * | 9/1994 | Mansoor et al. | 24/295 |
| 6,360,407 | B1 | * | 3/2002 | Webster et al. | 24/570 |
| 6,656,278 | B2 | * | 12/2003 | Baisch | 118/500 |
| 2003/0011201 | A1 | * | 1/2003 | Rodriguez et al. | 292/336.3 |
| 2009/0165253 | A1 | * | 7/2009 | Perche | 16/402 |
| 2009/0267355 | A1 | * | 10/2009 | Perche | 292/76 |

FOREIGN PATENT DOCUMENTS

| | | | | |
|---|---|---|---|---|
| EP | 0 545 797 | B1 | | 6/1993 |
| EP | 0 931 895 | A1 | | 7/1999 |
| FR | 2833562 | A1 | * | 6/2003 |
| WO | WO 03/004804 | A1 | | 1/2003 |

* cited by examiner

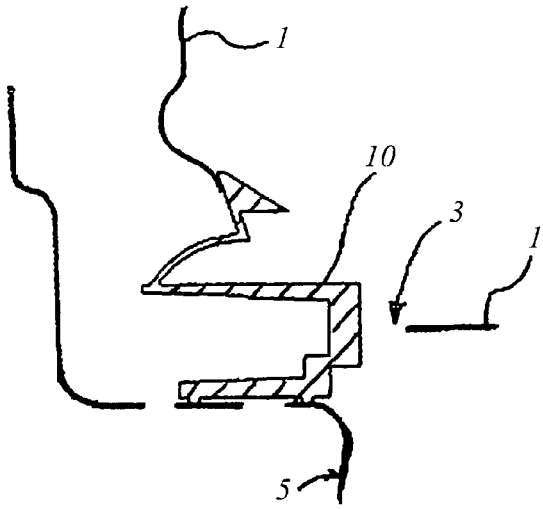
FIG.6C
FIG.7A
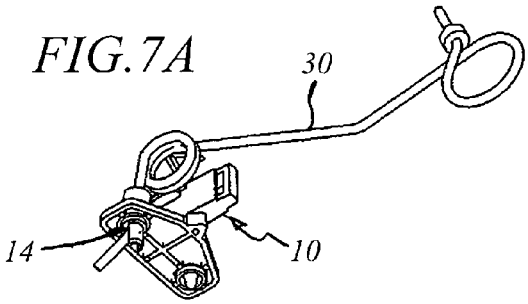
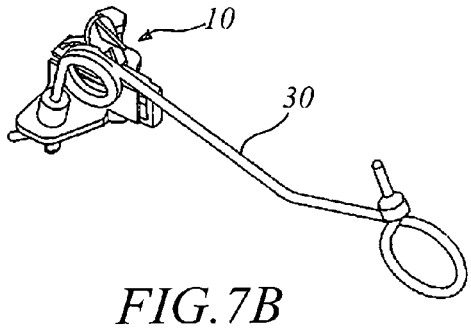
FIG.7B

TEMPORARY CLOSURE DEVICE FOR AN OPENING ELEMENT ON A FIXED CHASSIS PART OF A MOTOR VEHICLE, COMPRISING AN IMPROVED RETURN MEANS

BACKGROUND

The present invention relates to a temporary closure device for an opening element on a fixed chassis part of a motor vehicle.

Manufacturing chains for motor vehicles comprise chassis paint lines which are provided with opening elements, and particularly doors.

These opening elements are not yet equipped with closure or locking devices and it is therefore necessary to provide for temporary and removable closure devices which make it possible to maintain the opening elements in the closed position on the chassis during its transfer on the paint line.

Until now, temporary closure devices have been mounted in the location of the permanent lock using fixing members, such as screws, for example.

These devices are made up of metallic parts which have a lifespan at least equal to the duration of manufacturing of the vehicles on which they are used. The metallic parts risk damaging the chassis and/or the paint when they are placed or removed and they must regularly undergo various cleaning treatments, the frequency of which depends on the speed of fouling at each passage on the paint lines.

After cleaning, the temporary closure devices must undergo an operation on a control gauge to make them compliant once more.

Moreover, the devices for transferring between the paint lines and the cleaning center require transport infrastructure and significant investments.

A temporary closure device for an opening element on a fixed element is known, moreover, as illustrated in document EP 931 895 B1, resolving the preceding drawbacks, with a simple and economical design, not requiring any fixing member which allows greater ease and greater speed in placing and removing the device.

However, the device according to document EP 931 895 B1 has the drawback of comprising a tongue forming a means for retaining the opening element, which is subject to strong stresses and deformations during closure of the opening element on the fixed element. The stress to be overcome during this closure is therefore significant. Moreover, the bend radius of said tongue may cause the device to be covered in flakes of paint, which may constitute impurities that are particularly troublesome for later application of paint on the vehicle chassis.

The device according to the invention therefore aims to resolve the preceding drawbacks by proposing a temporary closure device for an opening element on a fixed chassis part of a motor vehicle, said opening element comprising a housing for receiving a lock and said fixed part comprising at least one tapped hole for fixing a strike, the device comprising a plastic body equipped with means for mounting same in the tapped hole, a first end of the device comprising a limit stop element which is intended to cooperate with a first rim of the housing as the opening element is being closed, while the second end of the device comprises a means for retaining the opening element in the closed position against the fixed part, which is intended to penetrate the housing behind a second rim thereof, the retaining means being formed by a resilient tongue which can bend under stress from the second rim when the opening element is moved from the free position to the closed position thereof, the area of the body that essentially corresponds to the base of the tongue extending into a plate which is suspended above a recessed area, the plate and the tongue being connected by means of an arch forming a flexible connection.

SUMMARY

According to other characteristics of the device according to the invention:

- the arch is connected to the tongue substantially in its middle, and to the plate substantially at its free end,
- the plate is faces a direction opposite the first end of the device,
- the tongue and the plate form an acute angle,
- the tongue, the plate and the arch are integral with the body of the device,
- the tongue comprises a flat extension facing the first end, said extension cooperating in contact by its edge with the second rim of the housing, during movement of the opening element from its free position towards its closed position,
- the extension is located in a plane substantially perpendicular to the plane of the tongue,
- the extension is generally triangle-shaped with one side forming a ramp moving away from the tongue as one goes from the end toward the base of said tongue,
- the extension is located at the end of the tongue,
- the thickness of the extension is less than 2 mm,
- the extension is attached to the tongue over a length between approximately one quarter and one half the length of the tongue,
- the tongue comprises a recessed part at its base,
- the limit stop element comprises a shock absorption means due to the contact of the first rim of the opening element during its closure on the fixed element,
- the absorption means is made up of a portion of material suspended relative to the body, such that it can distort locally under the stress of the first rim of the opening element,
- an opening is arranged in the body of the device going all the way through it,
- the body comprises, below its lower surface, a plate extending from either side of the body and perpendicular to said body, the lower surface of the plate being provided with a plurality of studs defining a space between the plate and the corresponding support surface of the fixed element,
- the studs have a length in the vicinity of 1 mm, defining an equivalent space between the plate and the corresponding support surface of the fixed element,
- the studs are distributed on the edge of the lower surface of the plate,
- the body of the device comprises a catching cavity allowing the passage and maintenance of a stiff wire at one of its ends, the wire being able at its other end to maintain the opening element in a half-open position,
- the body comprises a slug contributing to ensuring its fixing on the fixed element, by its introduction in the tapped hole, the cavity going through the slug along its longitudinal axis.

BRIEF DESCRIPTION OF THE DRAWINGS

Other characteristics and advantages of the invention will appear upon reading the following description done in reference to the appended drawings, in which:

FIGS. 6A, 6B and 6C are cross-section views according to the dotted line A-A shown in FIG. 3A, illustrating the sequence of operations during closing of the opening element on the fixed element, FIGS. 7A and 7B are perspective views of the temporary closure device according to the invention on which a separating means is mounted making it possible to keep the door distanced from the device.

DETAILED DESCRIPTION OF EMBODIMENTS

In these figures, a temporary closure device 10 for an opening element 1 on a fixed chassis part 5 of a motor vehicle is illustrated.

Indeed, manufacturing chains for motor vehicles comprise in particular chassis paint lines which are provided with opening elements, such as doors for example.

These opening elements are not yet equipped with closure devices or locks and it is therefore necessary to provide for temporary and removable closure devices which make it possible to maintain the opening elements in the closed position on the chassis.

Figure 1:
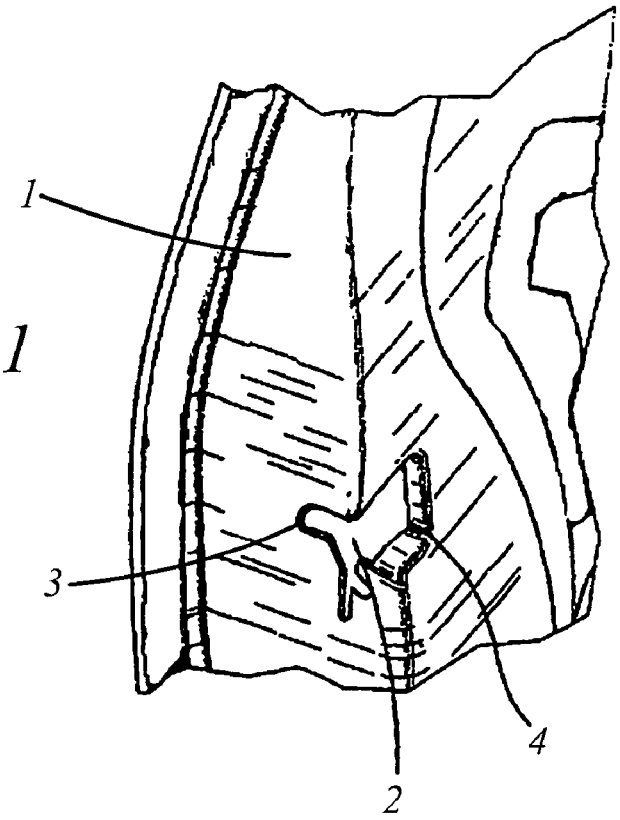
FIG. 1 is a diagrammatic perspective view of the internal surface of an opening element intended to be kept in the closed position by the temporary closure device.

As illustrated in FIG. 1, the opening element 1, which is formed by a door in the illustrated embodiment, comprises a housing 2 for receiving a lock.

The housing 2 is formed by a cut made on the internal surface of the opening element 1 and comprises in particular a rim 3 extending perpendicular to the plane of the opening element 1 and a rim 4 extending parallel to the plane of said opening element 1.

Figure 2:
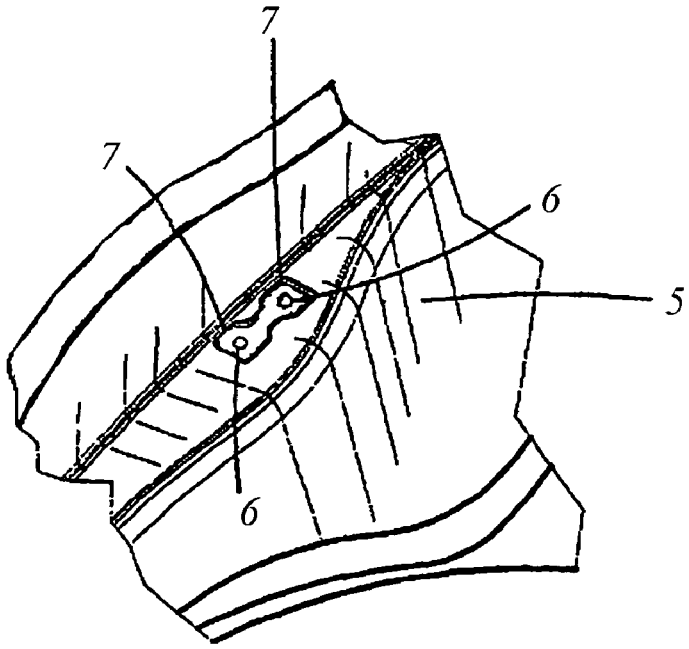
FIG. 2 is a diagrammatic perspective view of a fixed element of a chassis part intended to receive the temporary closure device.

These rims 3 and 4 are designed to cooperate with the temporary closure device 10, as we will see later. As shown in FIG. 2, the fixed element on which the opening element 1 is designed to be applied in the closed position, comprises at least one tapped hole 6 for receiving a strike.

In the embodiment illustrated in FIG. 2, the fixed element 5 comprises two parallel tapped holes 6.

Moreover, the fixed element 5 comprises a recess 7 in the axis of each tapped hole 6.

Figure 3A:
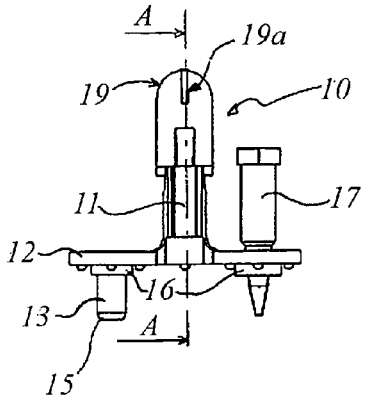
FIG. 3A, 3B, 3C and 3D are front, side, perspective, and front views, respectively, of the temporary closure device according to the invention.
Figure 3B:
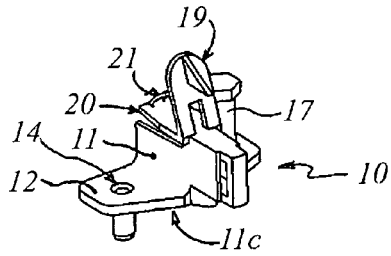
Figure 3C:
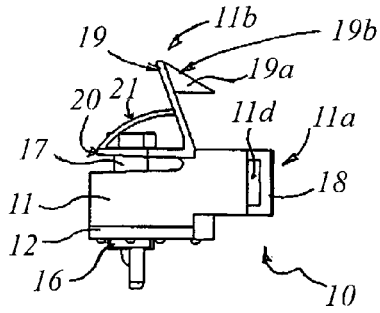
Figure 3D:
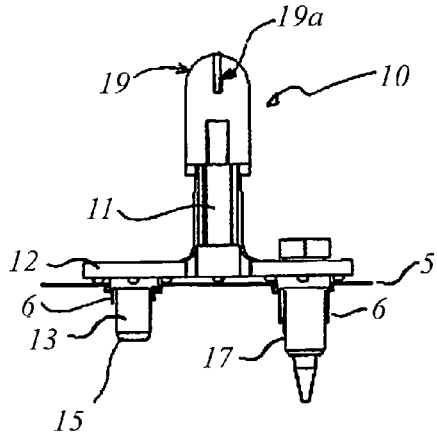

In general, the temporary closure device 10 illustrated in FIGS. 3A, 3B, 3C comprises a plastic body 11 which is equipped with means for mounting same in the tapped holes 6 and comprises, at a first end 11*a*, a limit stop element 18 which is intended to cooperate with the rim 3 of the housing 2 as the opening element 1 is being closed and, at a second end 11*b*, arranged above the body of the device, a means for retaining the opening element 1 in its closed position against the fixed part and intended to penetrate the housing 2 behind the rim 4.

Below its lower surface, the body 11 comprises a plate 12 extending on either side of the body 11 and perpendicular to said body 11, thereby forming lateral wings for fixing of the device 10 on the fixed element 5.

In this embodiment, the means for mounting the temporary closure device 10 on the fixed element 5 comprise fixing members formed, on one hand, by a slug 13 arranged below the plate 12, and on the other hand by a screw 17 integral with the body of the device and connected to the latter by lugs (screws that cannot be lost). The screw 17 is essentially located above the plate 12, ready to be screwed and to cross the plane of said plate 12. The slug 13 and the screw 17 are arranged substantially parallel to each other, each on a corresponding wing of the plate 12 and separated by the body 11.

The slug 13 and the screw can be arranged at the ends of the lateral wings of the plate 12.

The slug 13 comprises, at its free end, a centering cone 15 in the corresponding tapped hole 6, or a rounded surface having the same effect. Likewise, the screw 17 comprises, at its end, a centering cone or a rounded surface for the same purpose.

The assembly means also comprise means for engaging in the recesses 7 and which are made up of two shoulders 16 each arranged below the plate 12 in the corresponding axis of the slug 13 and the screw 17.

The slug 13 comprises a smooth guide surface and a cavity 14 allowing passage of a tool, such as a separating means 30, intended to maintain the opening element 1 distanced from the device 10 (FIGS. 7A and 7B). The slug 13 can be either completely cylindrical or half cylindrical, as shown in FIG. 3B.

The end 11*a* of the device has a substantially rounded shape, extending on the height of the body 11, so as to form means for guiding the rim 3 of the housing 2 which overlaps the body 11 as the opening element 1 is being closed.

Moreover, the limit stop element 18 of the device 10 comprises a shock absorption means due to the contact of the first rim 3 of the opening element 1 during its closing on the fixed element 5. This means is made up of a portion of material suspended relative to the body 11 of the device 10, so as to be able to distort locally and use the elastic properties of the material. In the embodiment described, an opening 11*d* is arranged in the body 11 of the device 10 going all the way through it. Thus the limit stop element 18 is formed by the center of the suspended portion.

The means for retaining the opening element 1 on the fixed element 5 is formed by a substantially flat resilient tongue 19 extending above the body 11 along an incline in the vicinity of 15 and 30° relative to the vertical plane, defined by the axes of the slug 13 and the screw 17 (FIG. 3B). The incline of the tongue is defined in the direction opposite the first end 11 a of the device 10.

As illustrated in FIGS. 3A, 3B and 3C, the tongue 19 comprises a flat extension 19*a*, perpendicular to the plane of the tongue 19, turned from the side of the first end 11*a*, i.e. from the side opposite the direction of closure of the opening element 1. The extension 19*a* cooperates in contact by its edge 19*b* with the second rim 4 of the housing 2, during movement of the opening element 1 from its free position toward its closed position.

One will note that the extension 19*a* can be generally triangle-shaped with one side of the triangle forming a ramp moving away from the tongue 19 as one goes from the end toward the base of said tongue 19. This ramp is intended to come into contact with the second rim 4 of the opening element during movement of the opening element from its free position, such that the contact area is reduced as much as possible.

This instantaneous contact area, during movement of the opening element 1, is almost localized, which facilitates sliding of the rim 4 and damages the smallest possible amount of paint when the device 10 is already covered in paint and is once again brought into contact with the opening element 1 when the latter is closed again.

Return means are also provided between the tongue 19 and the body 11 of the device so as to assist the tongue 19 in returning to its initial position after having been stressed in deformation under the stress of the opening element 1. The body 11 of the device 10 that essentially corresponds to the base of the tongue 19 extends into a plate 20, parallel to the plate 12, which is suspended above a recessed area.

This plate 20 constitutes a secondary tongue intended to take part of the stresses and deformation of the tongue 19. To do this, as illustrated in FIG. 3B, the tongue 19 and the plate 20 are connected by means of an arch 21 forming a flexible connection. The arch 21 is connected to the tongue 19 in its middle, and to the plate 20 at its free end. Bending of the tongue 19 is more limited as the stresses and deformation are distributed over various parts of the device 10.

Before passage on a paint line of the chassis on which the opening elements 1 were previously assembled, the fixed elements 5 of this chassis intended to receive the opening elements 1 when they are closed, are each equipped with a temporary closure device 10.

For this, the operator engages the centering cone 15 of the slug 13 in the corresponding tapped hole 6 of the fixed element 5 and exerts pressure on the body 11 such that, on one hand, the slug 13 penetrates a tapped hole 6 and, on the other hand, each shoulder 16 fits into a recess 7 arranged on the fixed element 5.

Preferably, the recesses 7 are square-shaped and the shoulders 16 are cylindrical in shape.

Figure 4:
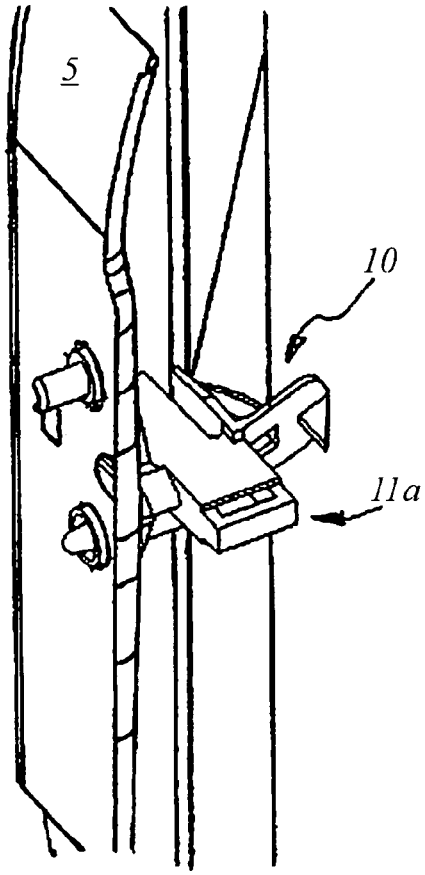
FIG. 4 is a diagrammatic perspective view of the temporary closure device according to the invention, mounted on the fixed element.
Figure 5:
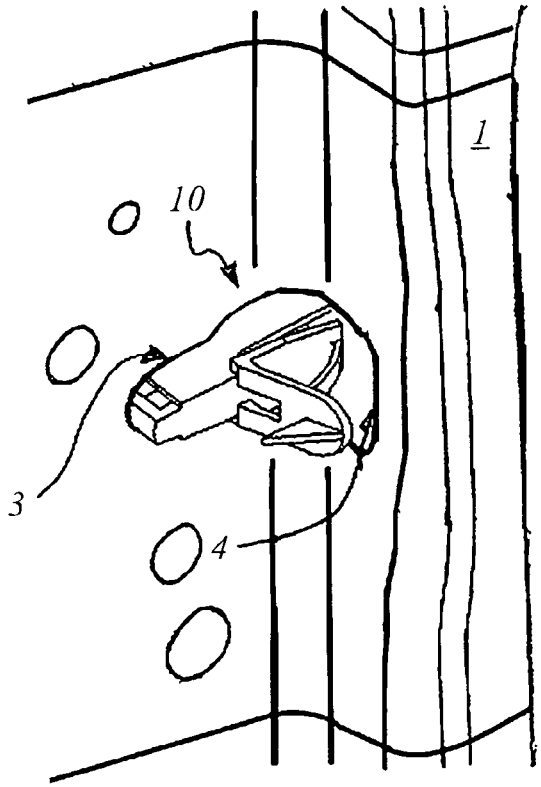
FIG. 5 is a diagrammatic perspective view of the temporary closure device according to the invention against which the opening element is arranged in abutment, the opening element thus being in the closed position.

The body 11 is applied on the fixed element 5 so that the lower surface 11*c* of this body 11 comes into contact with the fixed element 5, as illustrated in FIG. 4.

The operator first engages the slug 13 in the corresponding tapped hole 6 and then this operator screws the screw 17 in the other tapped hole 6.

Moreover, as can be seen in FIGS. 3A and 3B, the lower surface 11*c* of the plate 12 can be equipped with small studs intended to define a small space between the plate 12 and the corresponding support surface of the fixed element 1. This space makes it possible to facilitate the flow of liquid (surface and anticorrosion treatment) and to avoid sticking, in anticipation of the disassembly of the device 10.

Figure 6A:
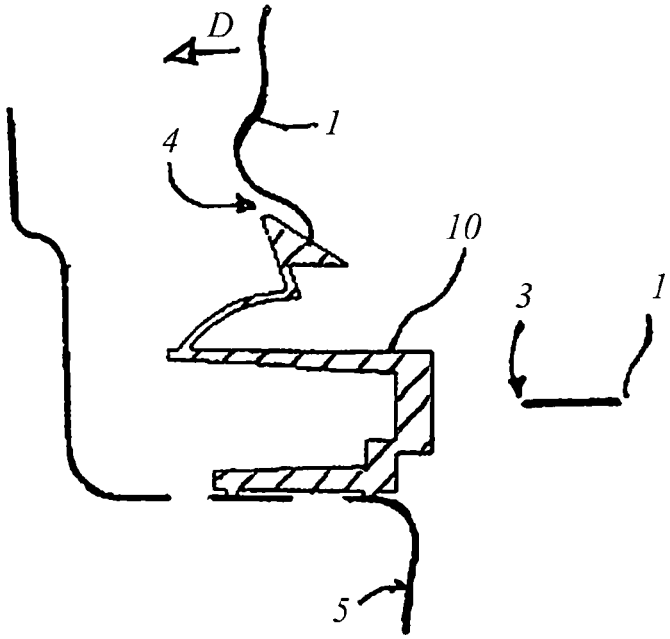
Figure 6B:
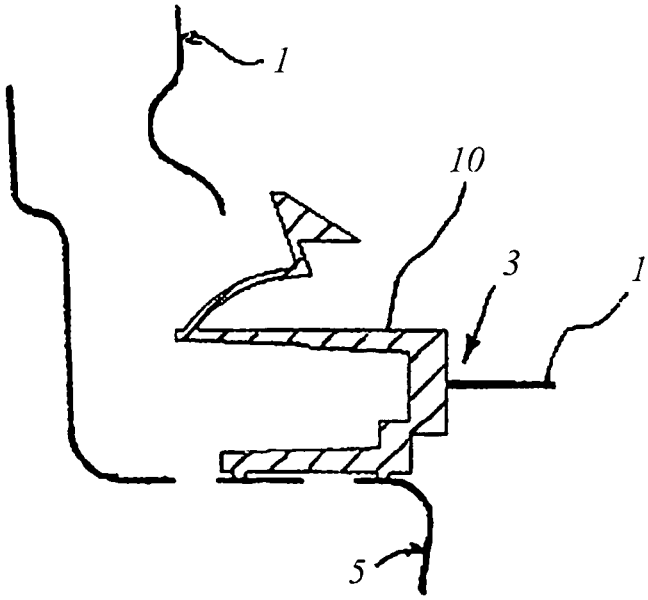

As illustrated in FIGS. 6A, 6B and 6C, during closing of the opening element 1 done manually or automatically, in the direction of movement of the arrow D (FIG. 6A), the rim 3 of the housing 2 arranged in said opening element 1 comes progressively into contact with the limit stop element of the end 11*a* of the device 10 while overlapping the body of the latter, which thus ensures automatic adjustment of the body 11 in relation to the housing 2.

Then, while continuing to push on the opening element 1, the rim 4 of the housing 2 causes the tongue 19 to bend, such that this rim 4 goes behind said tongue 19, as illustrated in FIG. 6.

Moreover, the edge 3 of the housing 2 is applied such that it abuts against the surface of the end 11*a* (FIG. 6B).

Then, the tongue 19 resumes its initial position thanks to its elasticity and ensures blocking of the rim 4 and consequently of the opening element 1.

To increase the locking effort of the opening element 1 on the fixed element 5 through the temporary closure device 10, one need only increase the width of the resilient tongue 19.

During opening of the opening element 1 which can be done manually or automatically, the resilient tongue 19 bends in the opposite direction so as to allow the rim 4 to pass, which allows opening of the opening element 1.

To remove the temporary closure device 10 from the fixed element 5, the operator first unscrews the screw 17 and then exerts tension on the body 11 so as to cause the slug 13 to exit the tapped hole 6.

The temporary closure device according to the invention avoids all damaging of the paint and/or the chassis during its placement or removal.

The invention claimed is:

1. A temporary closure device for an opening element on a fixed chassis part of a motor vehicle, said opening element comprising a housing for receiving a lock and said fixed chassis part comprising at least one tapped hole for fixing a strike, the device comprising:

a plastic body equipped with mounting means for mounting the device in said at least one tapped hole, a limit stop element disposed at a first end of the device and configured to cooperate with a first rim of the housing as the opening element is being closed, a means for retaining said opening element in a closed position against the fixed chassis part, the means for retaining said opening element being:

disposed at a second end of the device, and configured to penetrate the housing behind a second rim of the housing, the means for retaining being formed by a resilient tongue which can bend under stress from the second rim when the opening element is moved from a free position to the closed position thereof, wherein an area of the body that essentially corresponds to a base of the tongue extends into a plate which is suspended above a recessed area, the plate and the tongue being connected by means of an arch which is connected to the tongue in a middle of the tongue and to the plate at a free end of the plate forming a flexible connection.

2. The device according to claim 1, wherein the plate faces a direction opposite the first end of the device.

3. The device according to claim 1, wherein the tongue and the plate form an acute angle.

4. The device according to claim 1, wherein the tongue, the plate and the arch are integral with the body of the device.

5. The device according to claim 1, wherein the tongue comprises a flat extension facing the first end, said extension cooperating in contact by an edge with the second rim of the housing, during movement of the opening element from the free position toward the closed position.

6. The device according to claim 5, wherein the extension is located in a plane substantially perpendicular to a plane of the tongue.

7. The device according to claim 5, wherein the extension is generally triangle-shaped with one side forming a ramp sloping away from the tongue in a direction from an end toward the base of said tongue.

8. The device according to claim 5, wherein the extension is located at an end of the tongue.

9. The device according to claim 5, wherein the thickness of the extension is less than 2 mm.

10. The device according to claim 5, wherein the extension is attached to the tongue over a length between approximately one quarter and one half a length of the tongue.

11. The device according to claim 5, wherein the tongue comprises a recessed part at the base of the tongue.

12. The device according to claim 1, wherein the limit stop element comprises a shock absorption means due to the contact of the first rim of the opening element during closure on the fixed element.

13. The device according to claim 12, wherein the absorption means is made up of a portion of a material suspended relative to the body, such that the absorption means can distort locally under the stress of the first rim of the opening element.

14. The device according to claim 13, wherein an opening is arranged in the body of the device going completely through the body.

15. The device according to claim 1, wherein the body comprises, below a lower surface, a plate extending from either side of the body and perpendicular to said body, a lower surface of the plate being provided with a plurality of studs defining a space between the plate and a corresponding support surface of the fixed element.

16. The device according to claim 15, wherein the studs have a length in the vicinity of 1 mm, defining the space between the plate and the corresponding support surface of the fixed element which is equivalent to the length of the studs.

17. The device according to claim 15, wherein the studs are distributed on the edge of an lower surface of the plate.

18. The device according to claim 1, wherein the body of the device comprises a catching cavity allowing passage and maintenance of a stiff wire at a first end of the wire, the wire being able at a second end of the wire to maintain the opening element in a half-open position.

19. The device according to claim 18, wherein the body comprises a slug contributing to ensuring the fixing of the body on the fixed chassis part, by introduction of the slug in the at least one tapped hole, the cavity going through the slug along a longitudinal axis of the slug.

* * * * *